United States Patent [19]

Dennison et al.

[11] 4,321,007

[45] Mar. 23, 1982

[54] OUTER CASE COOLING FOR A TURBINE INTERMEDIATE CASE

[75] Inventors: William T. Dennison, East Hartford; David K. Jan, Manchester, both of Conn.

[73] Assignee: United Technologies Corporation, Hartford, Conn.

[21] Appl. No.: 106,414

[22] Filed: Dec. 21, 1979

[51] Int. Cl.[3] ..... F01D 25/16

[52] U.S. Cl. ..... 415/142; 415/175; 415/180

[58] Field of Search ..... 415/180, 175, 142; 60/39.08, 39.75

[56] References Cited

U.S. PATENT DOCUMENTS

| | | | |
|---|---|---|---|
| 2,869,941 | 1/1959 | Shoup | 415/142 |
| 3,057,154 | 10/1962 | Sherlaw et al. | 415/180 |
| 3,057,542 | 10/1962 | Keenan et al. | 415/180 |
| 3,084,849 | 4/1963 | Dennison | 415/175 |
| 4,156,342 | 5/1979 | Korta et al. | 60/39.08 |

*Primary Examiner*—Robert E. Garrett

*Attorney, Agent, or Firm*—Charles A. Warren

[57] ABSTRACT

A turbine intermediate case in which a turbine bearing support and an inner case are supported centrally within an outer case by radially inward extending hollow struts. An inner case carrying a diaphragm and seals which defines a vent cavity surrounding a bearing compartment. Air leaking past seals is collected in this vent cavity and flows through the hollow struts to be utilized for impingement cooling of the outer surface of the outer case.

6 Claims, 3 Drawing Figures

OUTER CASE COOLING FOR A TURBINE INTERMEDIATE CASE

BACKGROUND OF THE INVENTION

In a turbine installation which has a gas turbine acting as a generator for hot gas to power a free turbine the turbine intermediate case is located downstream of the gas generator turbine stages and between these stages and the free or power turbine. This support case is subject to severe thermal gradients and it has been found desirable to provide significant cooling for the outer ring or case forming a part of the outer engine structure.

In the copending application of Dennison Ser. No. 106,417 filed Dec. 21, 1979 is described a turbine intermediate bearing support structure in which there is a vent cavity adjacent the bearings in which air escaping past the seals is collected. This air has been vented to the atmosphere through the struts. Since this air is available and is relatively cool air, it is desirable that it be used for the purpose of cooling the outer case before escaping to the atmosphere.

SUMMARY OF THE INVENTION

A feature of the invention is the incorporation of an impingement cooling structure positioned to cool the outer case element of the support structure utilizing the vent air that surrounds the bearing support.

Another feature is the utilization of this air without detrimentally affecting the venting of the structure during turbine operation.

According to the invention the relatively heavy outer turbine case element has radially extending hollow struts that are welded at their inner end to the bearing support structure and the inner case element is welded to the struts. The inner case element carries seals upstream and downstream of the bearings to define a vent cavity and air from this vent cavity is discharged through the struts to a chamber outside of and surrounding the outer case. This chamber has impingement holes so located that air from the vent chamber and after passing through the struts is directed against the outer surface of the outer case for cooling it. This air then escapes through a discharge passage.

The foregoing and other objects, features and advantages of the present invention will become more apparent in the light of the following detailed description of preferred embodiments thereof.

DESCRIPTION OF THE PREFERRED EMBODIMENT

Figure 1:
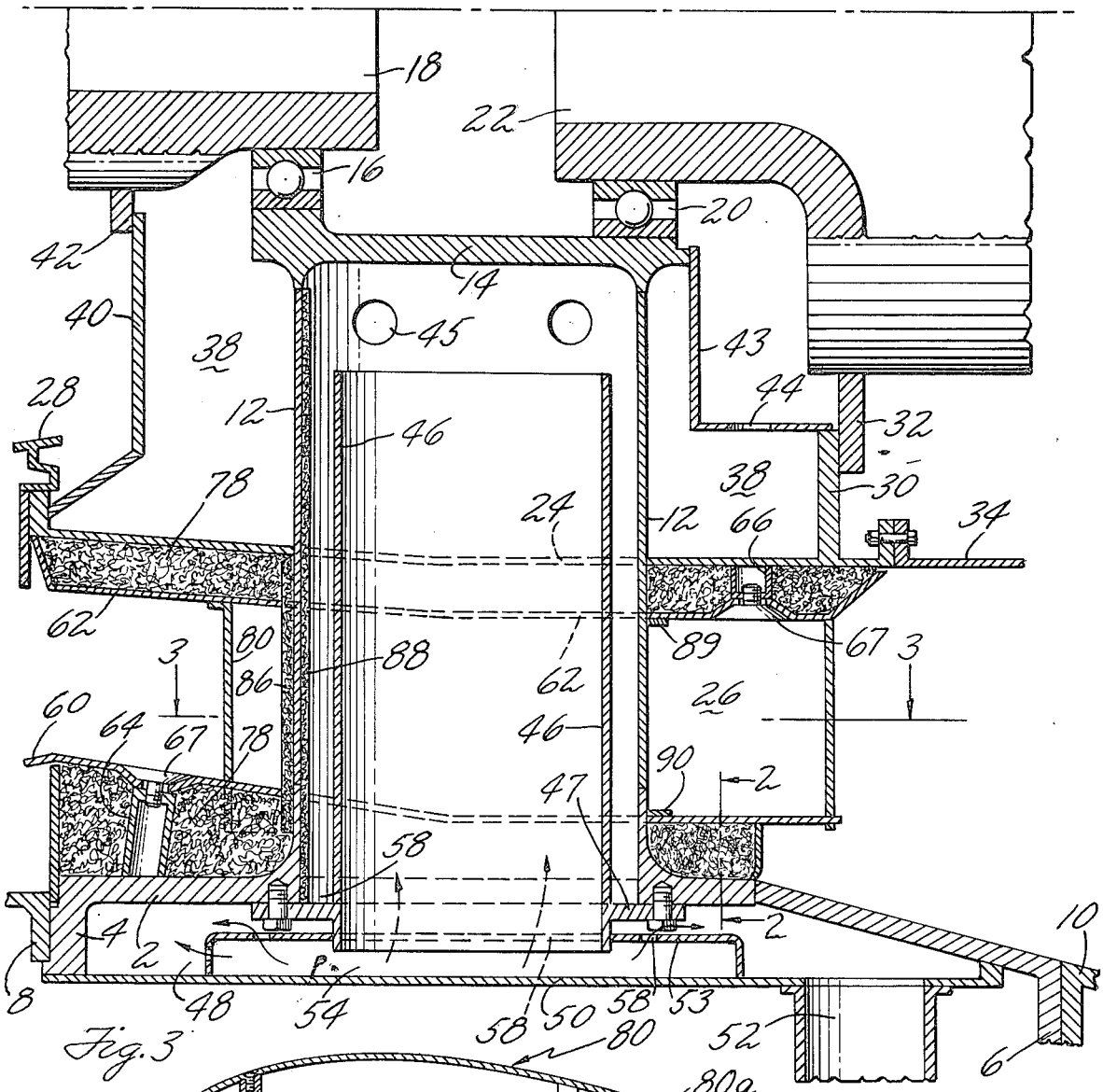
FIG. 1 is a sectional view through the turbine case.

Referring to FIG. 1 the invention is shown in a turbine intermediate case position between the last stage of the turbine forming a part of a gas generator and the first stage of the free or power turbine driven by gas under pressure from the gas generator. Such free turbine power plants are well known; they have many uses one in particular being the use of the free turbine to drive an electrical power generator. In such an installation the power plant is expected to be brought into operation in a very short time resulting in severe thermal gradients and when started to operate at a steady state for a long period of time resulting in long term thermal stresses that are desirably minimized to permit high performance of a power plant over long periods with a minimum of overhaul or repair.

As shown the outer case element 2 is relatively heavy and has mounting flanges 4 and 6 at opposite ends for attachment to the turbine case 8 of the gas generator and the turbine case 10 of the free turbine. A plurality of radial struts 12 extend inwardly from the outer case to support the bearing structure 14. The struts are preferably welded to both the outer case element and the bearing support structure. As shown, bearing 16 in the bearing structure 14 supports the turbine shaft 18 of the gas generator and bearing 20 supports the free turbine shaft 22.

The struts 12 also support an inner case 24 element or ring concentric to and spaced inwardly from the outer case element or ring to define a space for a gas path 26 therebetween. The inner case element is relatively thin and is desirably welded to the struts. The inner case element supports at its upstream end a seal 28 positioned at the downstream side of the last turbine stage of the gas generator. At its downstream end the inner case element has a flange or diaphragm 30 carrying a seal 32 for the front of the free turbine. The inner case element also has attached thereto a vane ring 34 for the inner ends of the vanes of the first free turbine stage. This ring is preferably bolted to the inner case as shown.

A vent cavity 38 surrounding the inner end of the struts and extending around the bearing support is formed at its downstream side by the flange 30 and seal 32. The upstream wall is a diaphragm 40 extending from the inner case at a point adjacent the seal 28 inwardly to the turbine shaft 18, the inner edge of the diaphragm 40 carrying a seal engaging the shaft. A baffle 43 extends from the flange 30 to the bearing support adjacent to the bearing 20 to shield the bearing from the relatively hot air leaking by the seal 32. Openings 44 in this baffle permit a flow of vent air past the baffle.

The vent cavity communicates with the hollow struts through openings 45 in the struts and air entering these holes flows outwardly in the struts being guided by a baffle or sleeve 46 in each strut itself as shown and supported by flanges 47 on the sleeves bolted to the outer case element. The outer ends of these sleeves are open to a chamber 48 surrounding the outer case element. The outer wall of the chamber being formed by panel segments forming a sleeve 50 secured at opposite ends to the outer case. This sleeve 50 has a vent port 52.

Within the chamber 48 is a flange ring 53 spaced from the sleeve 50 by the flanges and defining a chamber 54 into which the outer ends of the baffles or sleeves 46 extend so that vent air from the vent cavity 38 enters the chamber 54. This chamber 54 is thus surrounded on three sides by the chamber 48. The baffles 46 and insulation later described serve to retard the thermal response of the supporting struts to the flow of the hot vent air.

Air from the vent chamber 38 flowing out through the sleeve or baffle 46 enters the chamber 54 and is directed by a plurality of impingement holes 58 in the ring 53 against the outer surface of the outer case as best shown in FIG. 1. From these impingement holes air reaches the chamber 48 and escapes through the vent port 52.

To minimize heating of the inner and outer case elements, the gas path between these cases is defined by outer and inner annular shields 60 and 62 located between and spaced from the outer and inner case respectively. The outer shield is supported by angularly spaced stanchions 64 extending inwardly from the outer case element and the inner shield is supported by similar stanchions 66 extending outwardly from the inner case element. Bolts 67 hold the baffles in position as shown.

Figure 2:
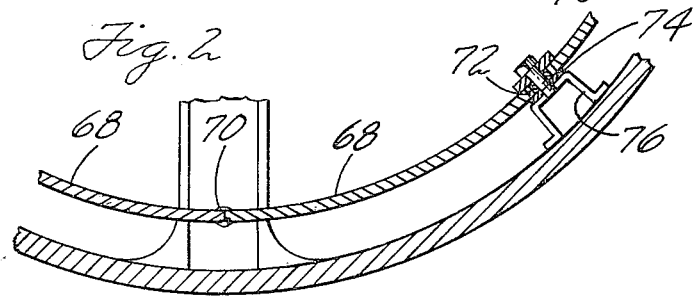
FIG. 2 is a sectional view along the line 2—2 of FIG. 1 showing a detail.

Both inner and outer shields are made in segments 68 and the segments are welded in pairs at 70 at the point where they surround the struts as shown in FIG. 2. Midway between the struts the segments have a circumferential gap 72 to accommodate thermal growth. This gap is sealed by supporting the panels or segments on a longitudinal strip 74 which is supported by stanchions 76 from the case element. The spaces between the outer shield and the outer case element and between the inner shield and the inner case are filled with insulation 78 as shown.

Figure 3:
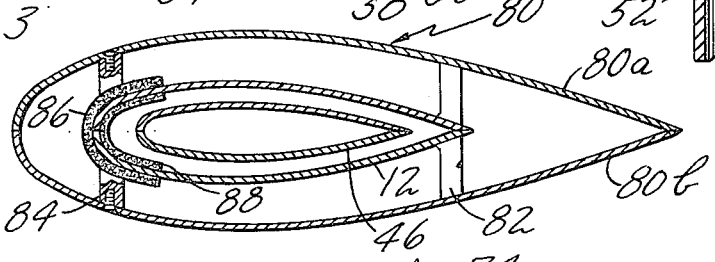
FIG. 3 is a fragmentary sectional view along the line 3—3 of FIG. 1.

The struts are protected by fairings 80 surrounding the struts in spaced relation. Each fairing is made up of two halves 80*a* and 80*b* mechanically attached to the struts as by bosses 82 on the struts, FIG. 3, and screws 84 extending through the fairing. Prior to positioning the fairings the leading edge of the strut at least and preferably the entire strut has insulation 86 thereon for thermal protection of the strut. The inner surface of the strut may also have insulation 88 thereon.

Where the struts extend through the inner shield 62, split collars 89 extend around the struts and are welded to both strut end segments of the baffle to seal the flow path at this point. Collars 90 at the outer baffle 62 are welded only to the baffle segments to permit sliding movement between the baffle and the strut for radial thermal expansion.

The effect of the structure above described is to minimize thermal effects during transient conditions which would otherwise be severe because of the short startup time or which would exceed the temperature limits of the case materials. The structure also provides for avoiding excessive thermal changes during steady state operation by the heat shield baffles cooling structure and insulation. In this way with a minimum of thermal stresses the structure is capable of very long term operation since thermal stresses are either avoided or reduced to a minimum whenever the power plant is in operation. The vent air escaping through the struts is utilized effectively for cooling the outer case element without affecting the escape of the air from the bearing support structure and with the significant benefit of a cooler outer case without the need for additional cooling art.

Although the invention has been shown and described with respect to a preferred embodiment thereof, it should be understood by those skilled in the art that other various changes and omissions in the form and detail thereof may be made therein without departing from the spirit and the scope of the invention.

Having thus described a typical embodiment of our invention, that which we claim as new and desire to secure by Letters Patent of the United States is:

1. A turbine bearing support including:

an outer case element;

an inner case element within and spaced from the outer case element;

a plurality of hollow radial struts secured to and extending inwardly from the outer case element and through the inner case element and having a plurality of vent holes near the inner end;

a bearing support secured to and supported by the inner ends of said struts;

a seal and diaphragm means carried by the inner case element and forming a vent cavity within the inner case communicating through the vent holes of the hollow strut;

a chamber external of the outer case element and having a plurality of impingement holes in the wall thereof for directing air against the outer case element; and a connection through the struts to said chamber for directing air from the vent cavity to the chamber.

2. A turbine bearing support as in claim 1 in which one of the seal means is located in a position to engage with a shaft carried by the bearing support with the air for the vent cavity supplied by leakage of air past said seal.

3. A turbine bearing support as in claim 1 in which a sleeve surrounds the outer case in spaced relation thereto with the chamber positioned in the space between the sleeve and the outer case.

4. A turbine bearing support as in claim 3 in which the chamber is attached to said sleeve with the plurality of impingement holes positioned in a wall of the chamber located in spaced relation to the outer case.

5. A turbine bearing support as in claim 1 in which the seal and diaphragm means include diaphragms at opposite sides of the bearing support with seals at their inner edges to engage with shafts supported by the bearings, the vent cavity being between the two diaphragms.

6. A turbine bearing support as in claim 4 in which the chamber is formed by a flanged ring positioned within the sleeve and with its flanges attached thereto, the impingement holes being in the ring.

* * * * *